US006670922B1

(12) United States Patent
Huang et al.

(10) Patent No.: US 6,670,922 B1
(45) Date of Patent: Dec. 30, 2003

(54) MINIATURIZED PLANAR ANTENNA FOR DIGITAL TELEVISION RECEPTION

(75) Inventors: Chi-Fang Huang, Taipei (TW); Li Chen, Pan-Chiao (TW)

(73) Assignee: Taiwan Telecommunication Industry Co., Ltd., Taipei (TW)

( * ) Notice: Subject to any disclaimer, the term of this patent is extended or adjusted under 35 U.S.C. 154(b) by 0 days.

(21) Appl. No.: 10/183,531

(22) Filed: Jun. 28, 2002

(51) Int. Cl.[7] ..... H01Q 1/38

(52) U.S. Cl. ..... 343/700 MS; 343/895

(58) Field of Search ..... 343/700 MS, 895, 343/795

(56) References Cited

U.S. PATENT DOCUMENTS 5,812,943 A * 9/1998 Suzuki et al. ..... 343/895
5,986,609 A * 11/1999 Spall ..... 343/702

* cited by examiner

*Primary Examiner*—Hoang V. Nguyen
(74) *Attorney, Agent, or Firm*—Rosenberg, Klein & Lee

(57) ABSTRACT

A miniaturized planar antenna of digital television reception includes a substrate and a plurality of antennas. Strip lines are formed on upper and lower surfaces of the substrates. A connector passing through the upper and lower surfaces of the substrate via a feeding line is connected at the center of the strip line on the lower surface of the substrate. Antennas extend from two sides of the strip lines, and are mirroringly distributed as their counterparts in the symmetric quadrants of these substrates. Each quadrant has three pairs of antennas. A plurality of gaps are further disposed at positions on each set of antennas adjacent to the strip lines.

10 Claims, 10 Drawing Sheets

MINIATURIZED PLANAR ANTENNA FOR DIGITAL TELEVISION RECEPTION

BACKGROUND OF THE INVENTION

1. Field of the Invention

The present invention relates to a miniaturized planar antenna for digital television reception and, more particularly, to a miniaturized planar antenna, which is formed in a rampart-line manner by the use of printed copper foil technology, thereby to shrink the antenna size and effectively receive signals of digital television.

2. Description of Prior Arts

Presently, there are three kinds of standards for the digital television broadcasting, which are ATSC promoted by U.S., DVB-T of EU, and ISDB-T of Japan, and each of whom has its respective advantages.

However, U.S. has encountered a serious problem of multi-path problem when promoting ATSC standard; that is, corresponding signals of ATSC system may not be received via indoor antennas, and they should be replaced by larger-size outdoor antennas for the purpose of interference attenuation. On the other hand, COFDM signals of DVB-T system are proved to be with the stronger ability of dealing with multi-path interference.

Moreover, the DVB-T system has mobile reception capacity. In the future media environment, digital television channels are no longer restricted to transmission of television programs, but can provide services like data broadcasting for the trendy wireless and mobilized development. The DVB-T system also can deal with electromagnetic waves from many directions for further signal enhancement. That is why the DVB-T system can incorporate with the single frequency network (SFN).

Because the characteristic of mobile reception, the DVB-T system can further provide high-fidelity television programs and data transmission services to passengers in buses, trains, taxis, sedans, or recreation vehicles.

However, the digital television antenna of DVB-T system has drawbacks like large size and inferior portability, resulting in the bottleneck while in promotion.

SUMMARY OF THE INVENTION

The primary object of the present invention is to provide a miniaturized planar. antenna of digital television, which can be used in the DVB-T system to improve the aforementioned drawbacks of conventional DVB-T antennas. The present invention antenna is miniaturized and planarized to facilitate portability and mobility.

To achieve the above object, the present invention provides a miniaturized planar antenna of digital television. The present invention antenna includes a substrate and a plurality of radiators. Strip lines are set on each of the upper and lower surfaces of the substrate via the printed copper foil technology. The antennas are arranged in a rampart-line manner, and parallel disposed on the upper and lower surfaces of the substrate. The antennas intersect the stripe lines, and are distributed in two symmetric quadrants, each of which includes at least three sets of antennas.

The present invention also provides a miniaturized planar antenna of digital television having a plurality of substrates and antennas. These substrates are grouped into first substrates, second substrates, and insulating substrates, respectively. The insulting substrate is sandwiched by the first and second substrates. Strip lines are set on each of the upper and lower surfaces of the first and second substrates by the printed copper foil technology. The antennas are arranged in a rampart-line manner, and parallel disposed on the upper and lower surfaces of the first and second substrates, and intersect the stripe lines. The antennas are distributed in the second and fourth quadrants on the upper and lower surfaces of the first substrate and in the first and third quadrants on the upper and lower surfaces of the second substrate. Each quadrant includes at least three pairs of antennas.

The various objects and advantages of the present invention will be more readily understood from the following detailed description when read in conjunction with the appended drawing, in which:

BRIEF DESCRIPTIOB OF THE PREFFERED EMBODIMENT

Figure 1:
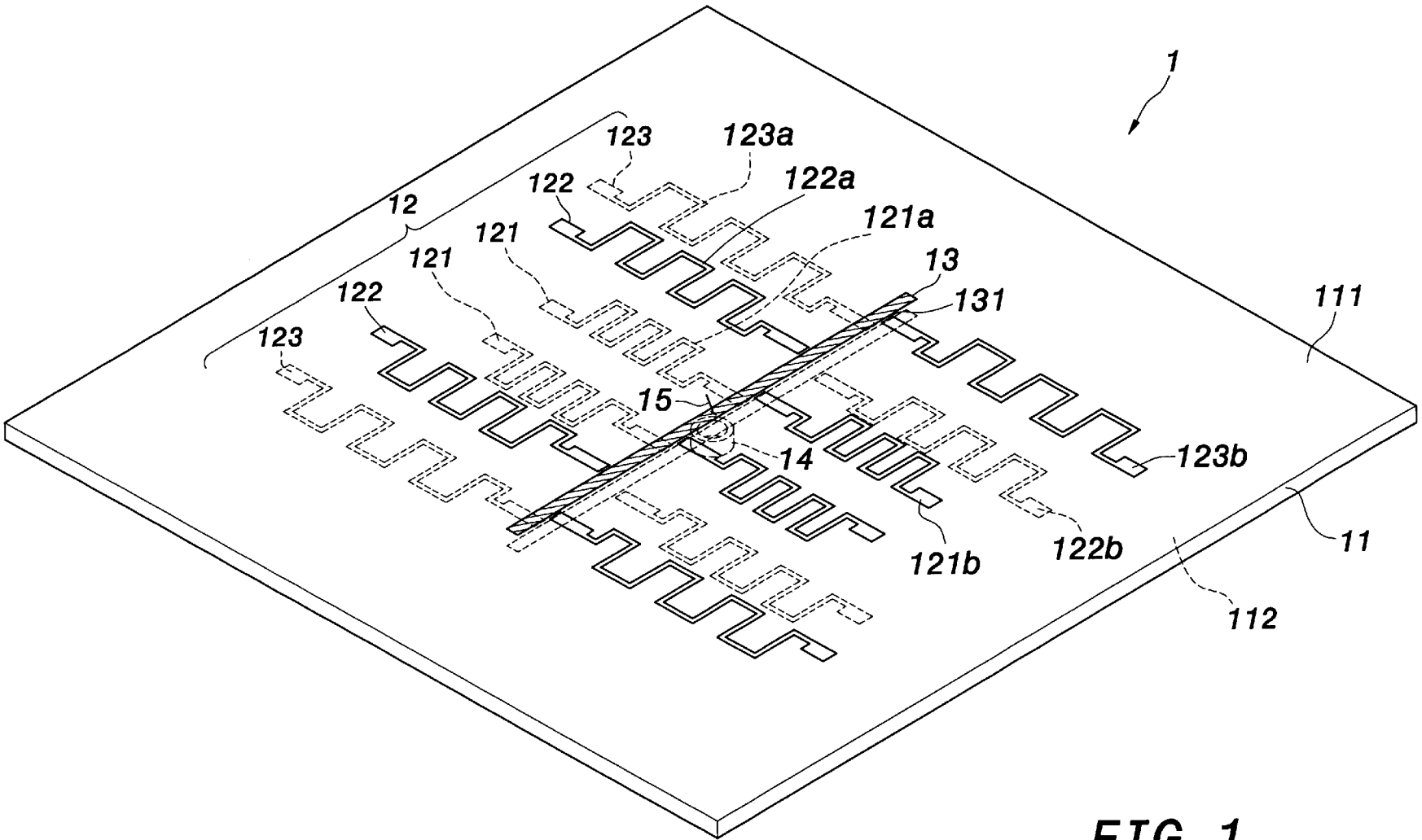
FIG. 1 is a perspective view of a first embodiment of the present invention.
Figure 1A:
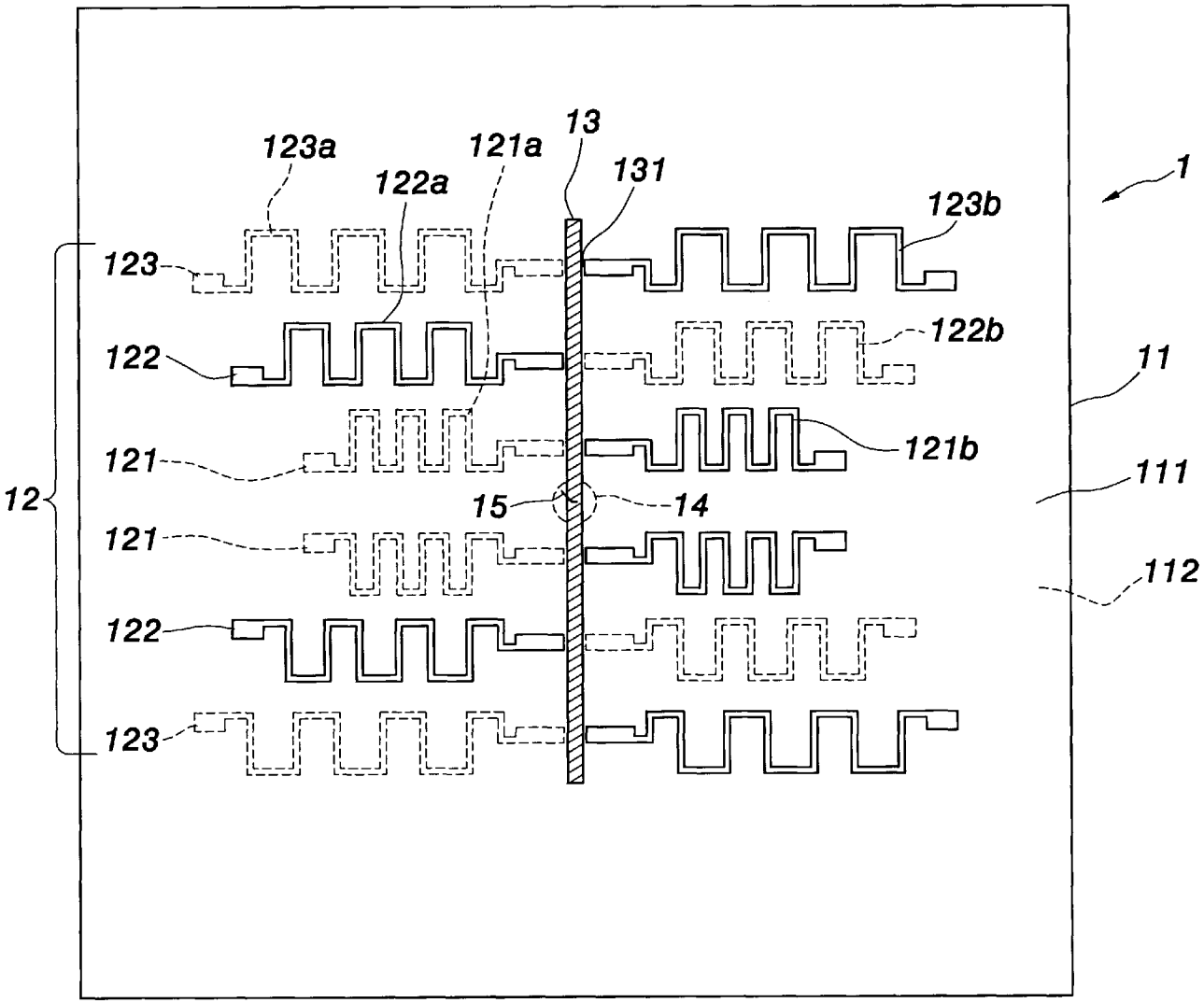
FIG. 1A is a top view of the first embodiment of the present invention.
Figure 1B:
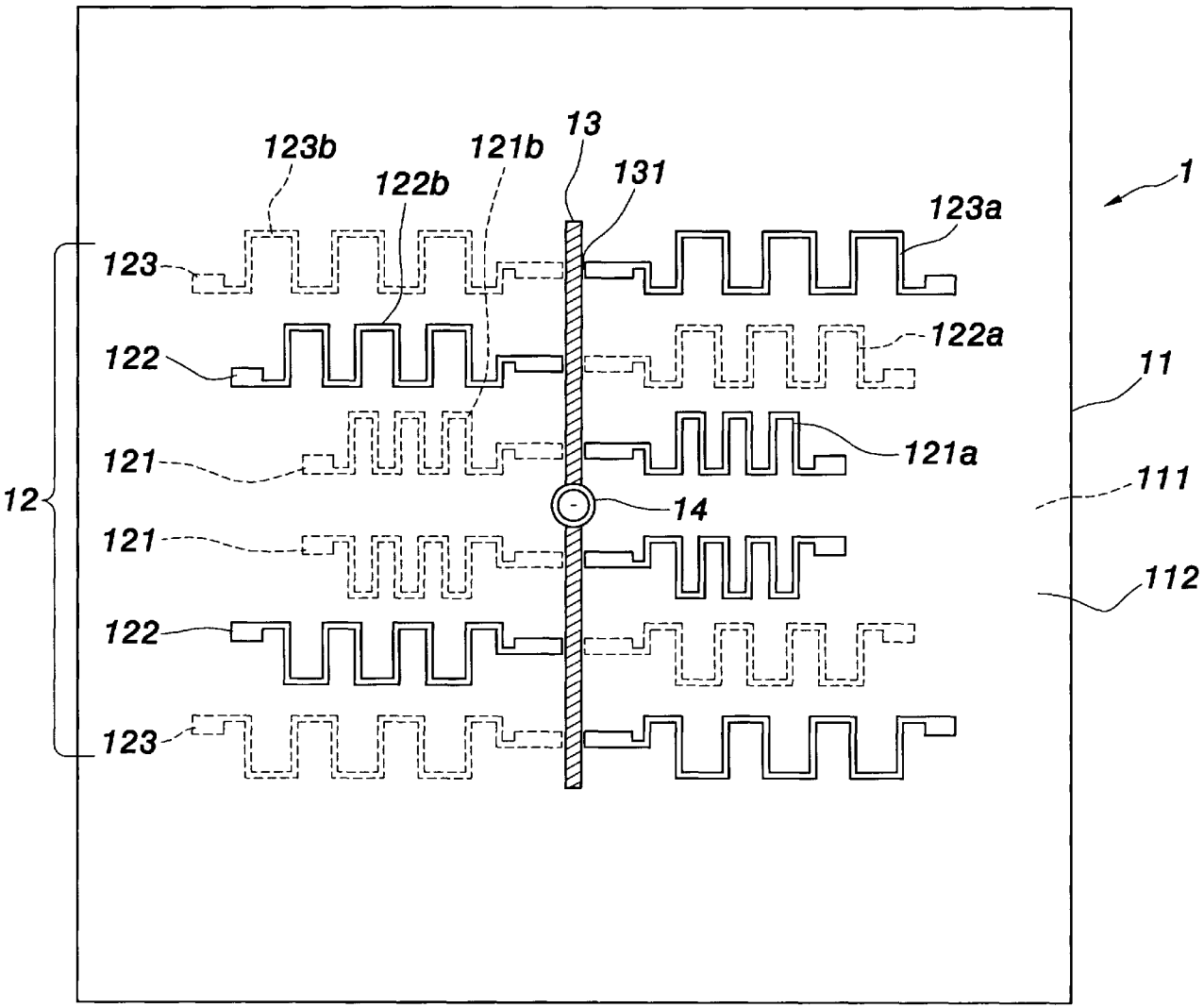
FIG. 1B is a bottom view of the first embodiment of the present invention.

As shown in FIGS. 1, 1A, and 1B, a miniaturized planar antenna 1 of digital television according to a first embodiment of the present invention includes a substrate 11 and a plurality of antennas 12.

The substrate 11 is made of one dielectric material with the predetermined thickness and dielectric constant such as FR-4, Mylar, ceramic, or Kapton. In this embodiment, a FR-4 printed circuit board. (PCB) is used as the substrate 11. The thickness is preferably to be 0.5 to 3 mm.

Strip lines 13 are set on upper and lower surfaces 111 and 112 of the substrate 11. A connector 14 is connected at the center of the strip line 13 on the lower surface 112 of the substrate 11. A feed line 15 passes through the upper and lower surfaces 111 and 112 of the substrate 11.

Antennas 12 electrically connected to the strip lines 13 vertically extend from two sides of the strip lines 13. The antennas 12 are arranged in a rampart-line manner, and distributed in the second and fourth quadrants of a circular azimuth of the substrate 11. Each quadrant has three pairs of antennas, respectively being a first set 121, a second set 122, and a third set 123. The three sets of antennas are parallel arranged. The antenna length at the outer edge of the substrate 11 is larger than that at the inner one, as shown as in FIG. 1B. In the second quadrant, a left half 121*a* of the first set 121 is disposed on the lower surface 112 of the substrate 11, and a right half 121*b* of the first set 121 is disposed on the upper surface 111 of the substrate 11; a left half 122*a* of the second set 122 is disposed on the upper surface 111 of the substrate 11, a right half 122*b* of the second set 122 is disposed on the lower surface 112 of the substrate 11; a left half 123*a* of the third pair 123 is disposed on the lower surface 112 of the substrate 11, a right half 123*b* of the third set 123 is disposed on the upper surface 111 of the substrate 11. In the fourth quadrant, the symmetric quadrant to the second quadrant, antennas are mirroringly arranged by their counterparts in the second quadrant. This way of arrangement will facilitate the feeding design more easily as compared to disposing the left halves 121*a*, 122*a*, and 123*a* and the right halves 121*b*, 122*b*, and 123*b* of the three sets of antennas on the same surface of the substrate 11.

Besides, because the whole antenna 12 is more inductive, a plurality of gaps 131 (whose width is from 0.01 to 2 mm preferably) can be disposed at positions on each pair of antennas 12 adjacent to the strip lines 13 to generate the capacitive coupling for the purpose of further LC resonance, thereby obtaining a wide band operation.

Figure 2:
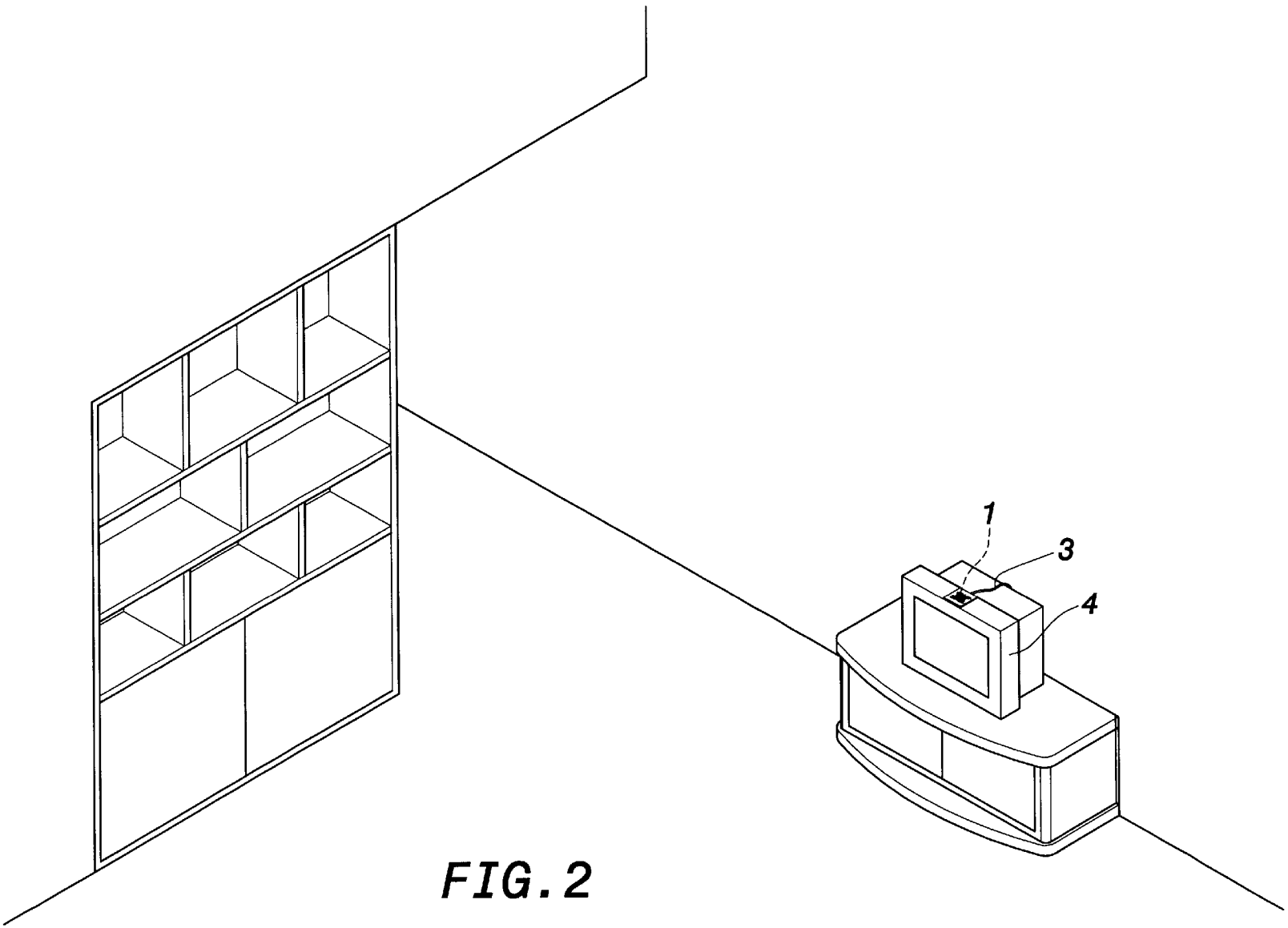
FIG. 2 shows the first embodiment of the present invention for indoor reception.

As shown in FIG. 2, the miniaturized planar antenna 1 of the present invention can be arbitrarily placed indoors for indoor reception. The connector 14 is connected to a digital television receiver 4 via a cable 3. Alternatively, the connector 14 is connected to a set top box (not shown) via the cable 3, and an analog television (not shown, either) is then used to receive digital television signals of the DVB-T system.

Figures 3, 3A:
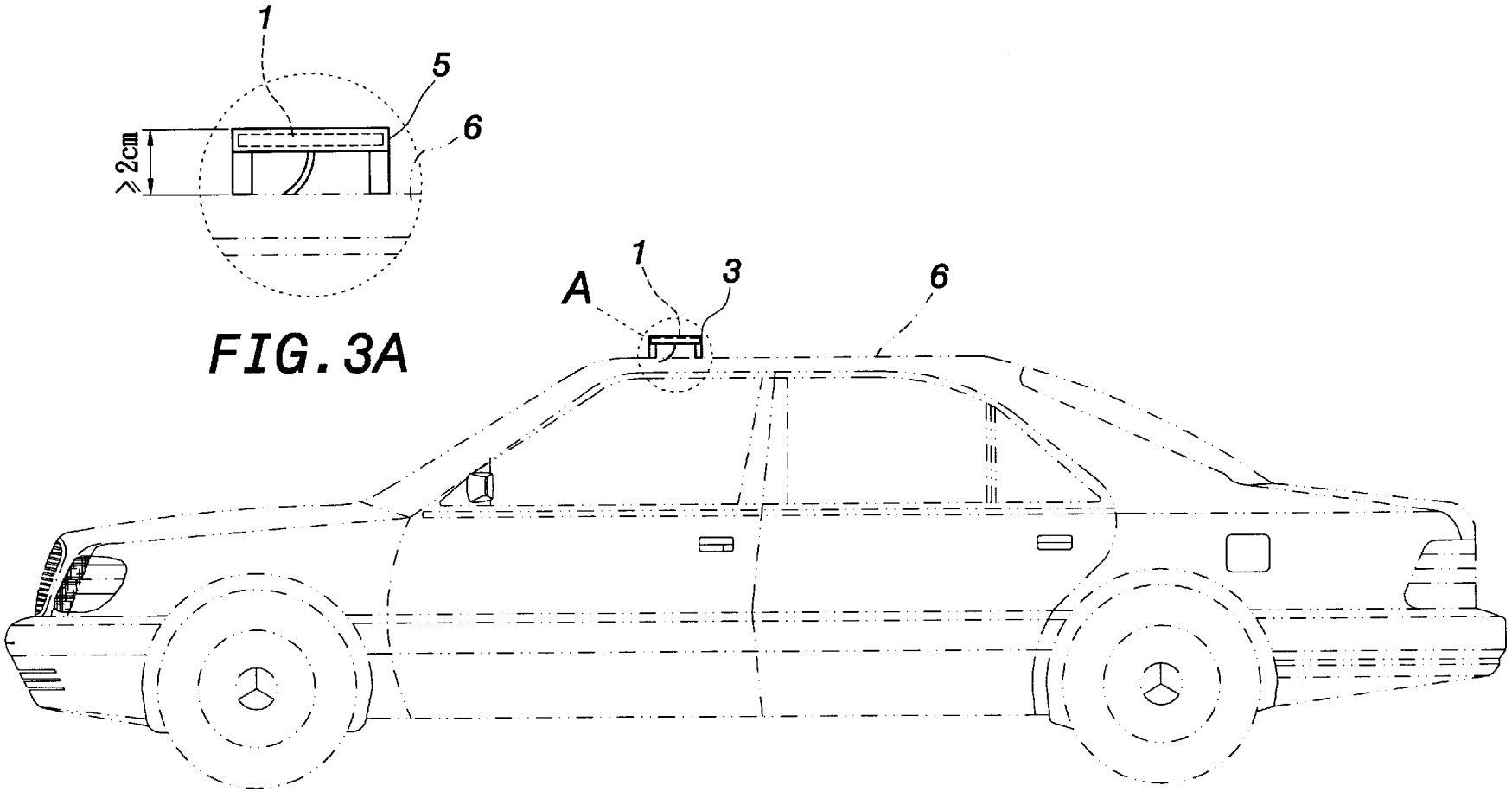
FIG. 3 shows the first embodiment of the present invention for mobile reception.
FIG. 3A is a partly enlarged view of FIG. 3.

As shown in FIGS. 3 and 3A, the miniaturized planar antenna 1 can be placed in a housing 5 (in addition to protecting the antenna structure, the housing 5 can also be of a different shape for the purpose of decoration or advertisement). A driver or a passenger can arbitrarily mount it on a car roof 6 for mobile reception. Because an appropriate distance is kept between the antenna 1 in the housing 5 and the metal plate of the car roof 6, the car roof 6 can be regarded as a ground plane. Additionally, a better reception can be achieved if the miniaturized planar antenna 1 is away from the bottom of the housing 5 more than 2 cm.

As shown in FIGS. 4, 5, 5A, and 6, a miniaturized planar antenna 2 of digital television reception according to a second embodiment of the present invention includes a plurality of substrates, such as 211 and 212, and a plurality of antennas 22.

The substrates are made of dielectric material with predetermined thickness and dielectric constant such as FR-4, Mylar, ceramic, or Kapton. In this embodiment, FR-4 printed circuit boards (PCB) are used as the substrate. The thickness of substrate is preferably to be 0.5 to 3 mm. The substrates include a first substrate 211, a second substrate 212, and an insulating substrate 213, which is sandwiched between the first and second substrate 211 and 212.

Strip lines 23 are formed on upper and lower surfaces 2111 and 2112 of the first substrate 211 by the printed copper foil technology. Antennas 22 electrically connected to the strip lines 23 vertically extended from two sides of the strip lines 23. The antennas 22 are arranged in a rampart-line manner, and are distributed in all four quadrants of a circular azimuth of the first substrate 211, as shown as FIG. 4. Each quadrant has three pairs of antennas, respectively being a first set 221, a second set 222, and a third set of antennas 223. These three pairs of antennas are parallel arranged. The antenna length at the outer edge is larger than that at the inner one. In the second quadrant, a left half 221*a* of the first set 221 is disposed on the lower surface 2112 of the first substrate 211, and a right half 221*b* of the first set 221 is disposed on the upper surface 2111 of the first substrate 211; a left half 222*a* of the second set 222 is disposed on the upper surface 2111 of the first substrate 211, a right half 222*b* of the second set 222 is disposed on the lower surface 2112 of the first substrate 211; a left half 223*a* of the third set 223 is disposed on the lower surface 2112 of the first substrate 211, a right half 223*b* of the third set 223 is disposed on the upper surface 2111 of the first substrate 211. It is obvious that antennas are mirroringly arranged as their counterparts in symmetric quadrants. This way of arrangement will facilitate feeding design more easily as compared to disposing the left halves 221*a*, 222*a*, and 223*a* and the right halves 221*b*, 222*b*, and 223*b* of the three sets of antennas on the same side of the first substrate 211.

Figure 4:
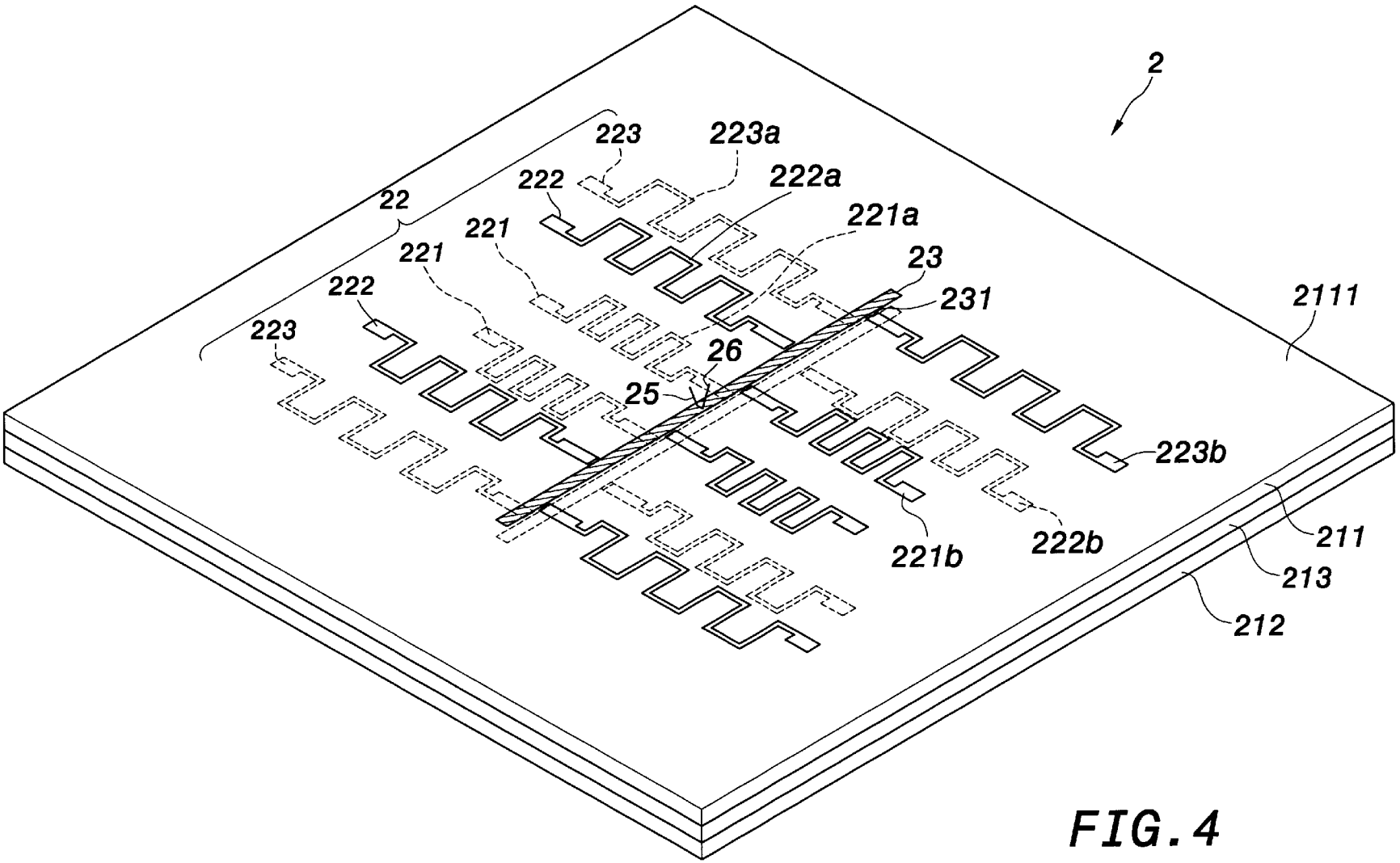
FIG. 4 is a perspective view of a second embodiment of the present invention.
Figure 5:
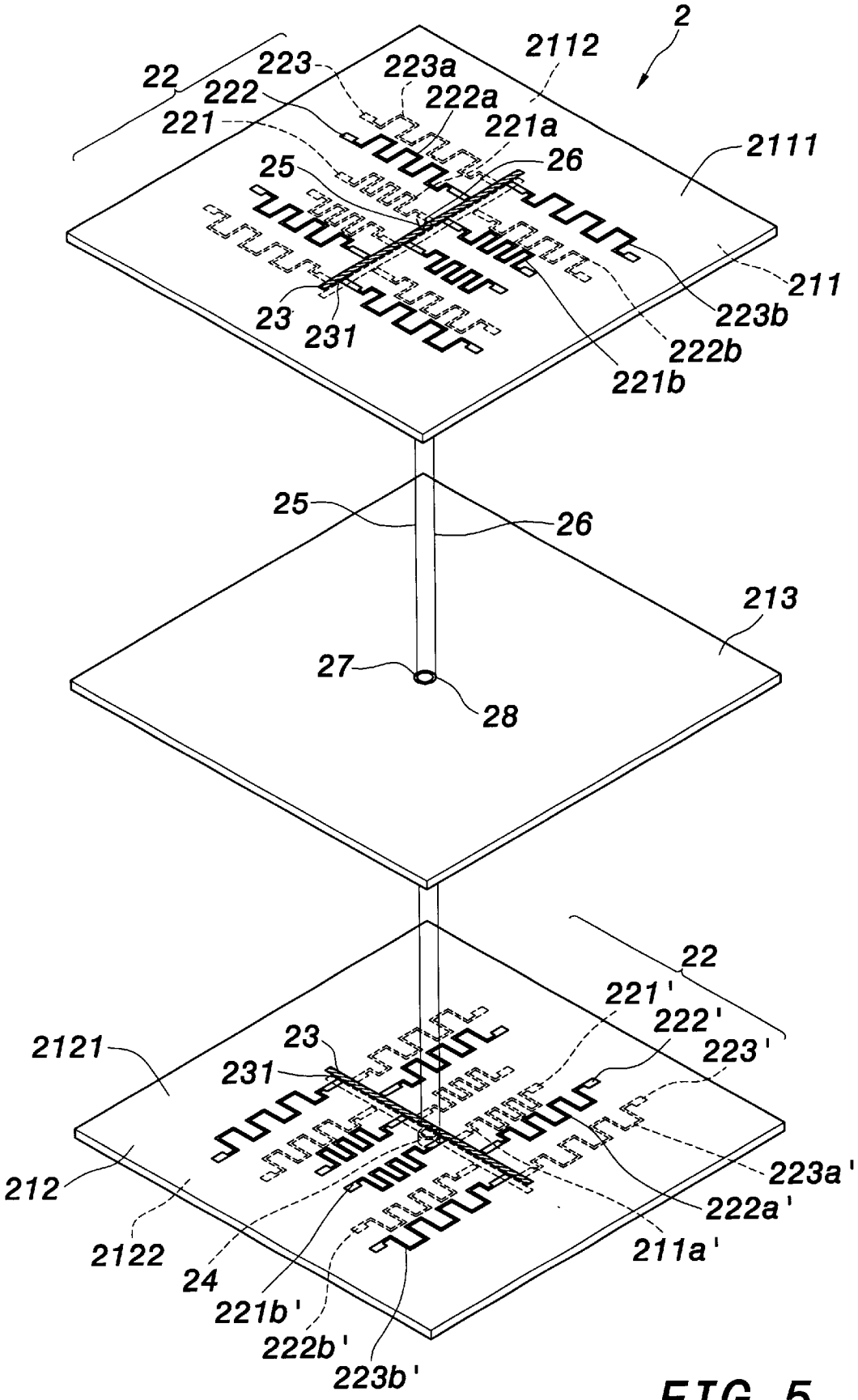
FIG. 5 is an exploded diagram of the second embodiment of the present invention.
Figure 5A:
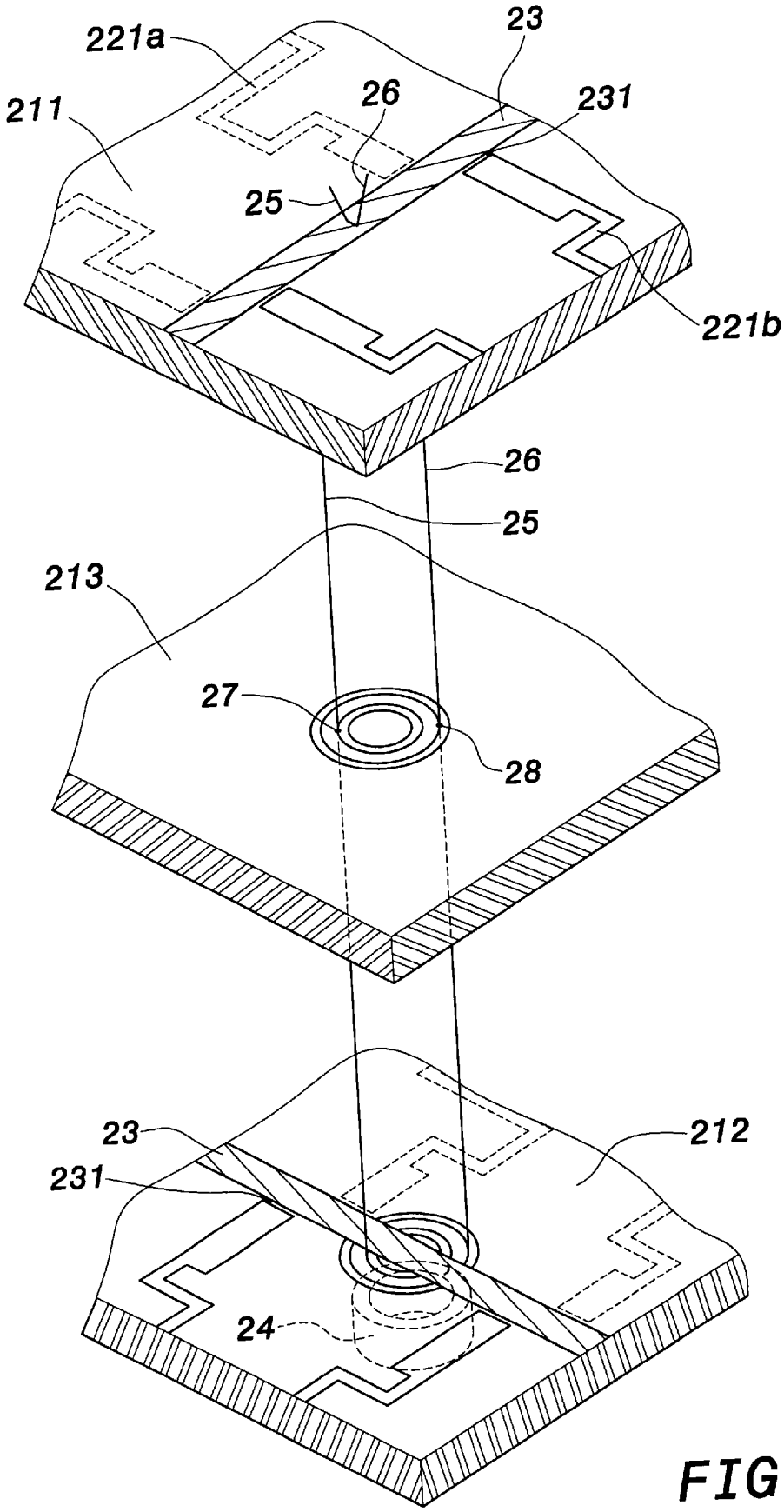
FIG. 5A is a partly enlarged view of FIG. 5.
Figure 6:
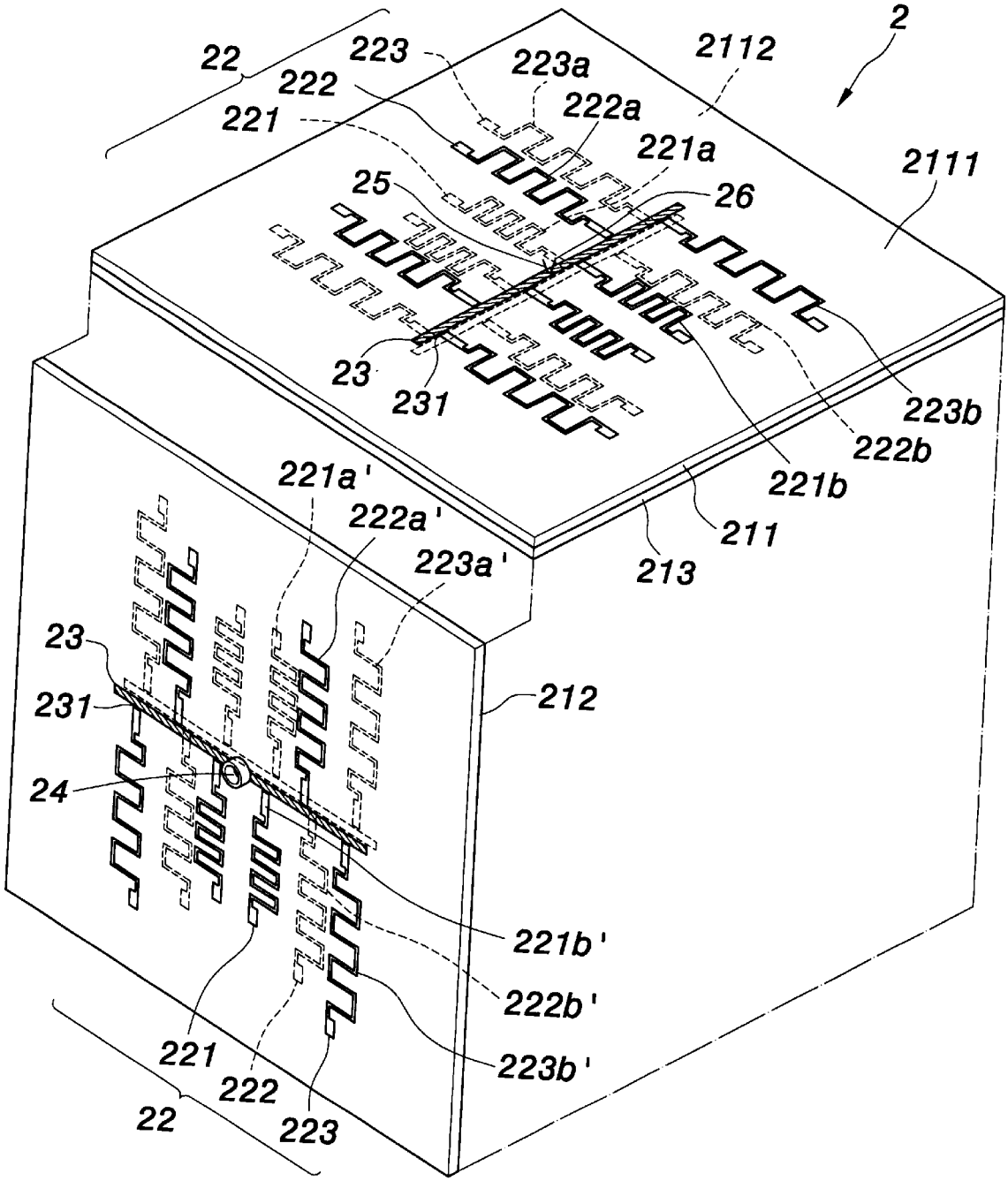
FIG. 6 is another exploded diagram of the second embodiment of the present invention.
Figure 7:
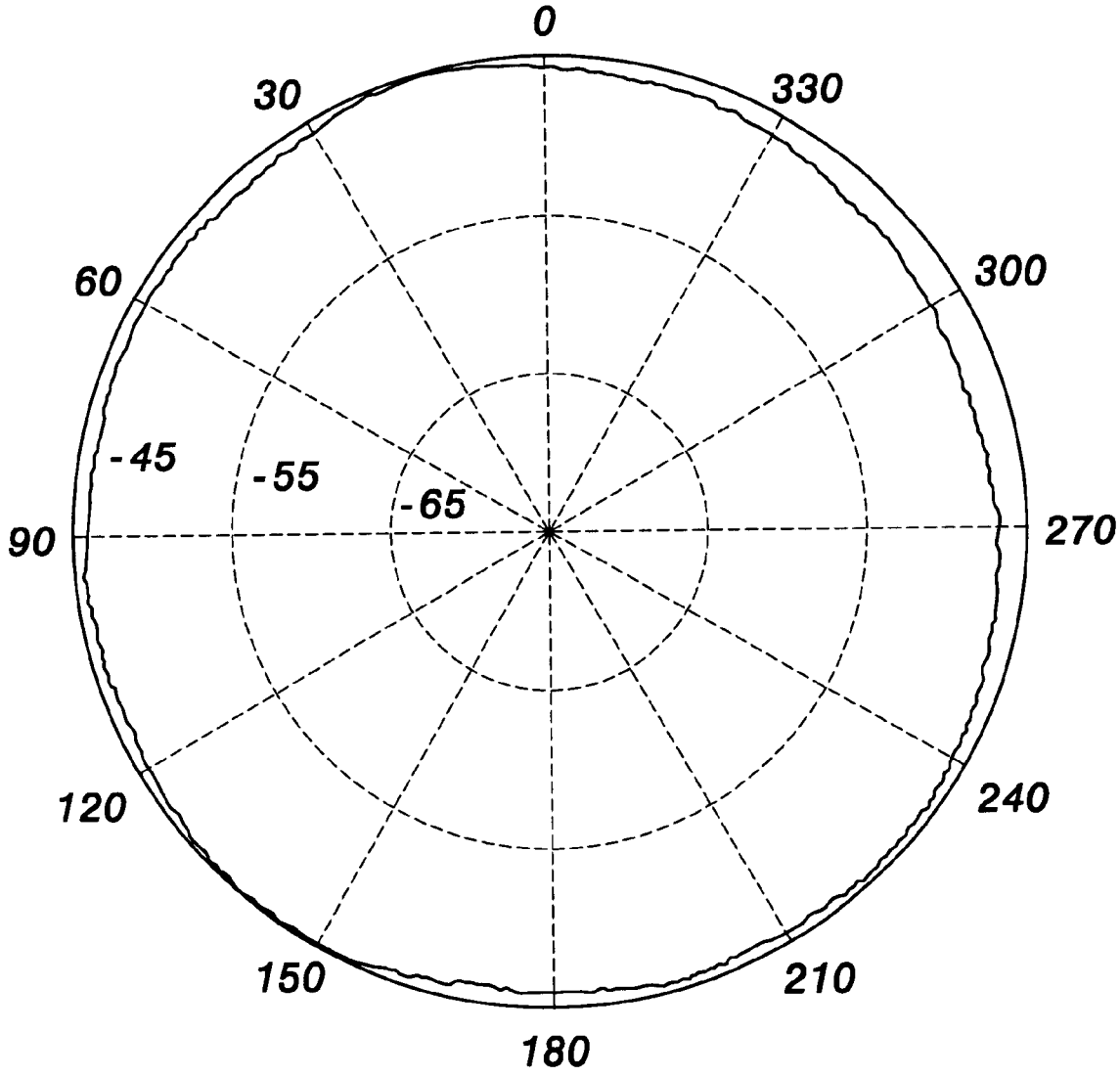
FIG. 7 is a measured radiation field pattern according to the second embodiment of the present invention.

Please refer to FIG. 5, in the same manner shown in FIG. 4, strip lines 23 are formed on upper and lower surfaces 2121 and 2122 of the second substrate 212. The antennas 22 electrically connected to the strip lines 23 vertically extended from two sides of the strip lines 23. The antennas 22 are arranged in a rampart-line manner, and distributed in all four quadrants of a circular azimuth of the second substrate 212. Each quadrant has three pairs of antennas, respectively being a first set 221', a second set 222', and a third set of antennas 223'. The three pairs of antennas are parallel arranged. The antenna length at the outer edge is larger than that at the inner one. In the first quadrant, a left half 221*a*' of the first set 221' is disposed on the lower surface 2122 of the second substrate 212, and a right half 221*b*' of the first set 221' is disposed on the upper surface 2121 of the second substrate 212; a left half 222*a*' of the second set 222' is disposed on the upper surface 2121 of the second substrate 212, a right half 222*b*' of the second set 222' is disposed on the lower surface 2122 of the second substrate 212; a left half 223*a*' of the third set 223' is disposed on the lower surface 2122 of the second substrate 212, a right half 223*b*' of the third set 223' is disposed on the upper surface 2121 of the second substrate 212. In the third quadrant, the symmetric quadrant to the first quadrant, antennas are mirroringly arranged as their counterparts in the first quadrant. The antenna structures of the second substrate 212 and the first substrate 211 are the same, and only occupy different quadrants. That is, the arrangement of the antennas 22 of the second substrate 212 is vertical to that of the antennas 22 of the first substrate 211. A horizontally polarized omnidirectional radiation pattern can be formed for reception of electromagnetic waves, as shown in FIG. 7.

A connector 24 is connected at the center of the strip line 23 on the lower surface 2122 of the second substrate 212. A first feeding line 25 and a second feeding line 26 pass through the upper and lower surfaces of the first substrate 212, the insulating substrate 213, and the first substrate 211. The two feeding lines 25 and 26 are 0.5 to 3 mm apart. The first feeding line 25 connects the upper surface 2111 of the first substrate 211 to the upper surface 2121 of the second substrate 212 by means of electroplating via a small aperture 27. The second feeding line 26 connects the lower surface 2112 of the first substrate 211 to the lower surface 2122 of the second substrate 212 by means of electroplating via a large aperture 28.

Because the whole antenna 22 is tend to be inductive, the present invention further includes a plurality of gaps 231, whose width is preferably to be 0.01 to 2 mm, at positions on each set of antennas 22 adjacent to the strip lines 23 to generate capacitive coupling for LC resonance, thereby obtaining a wide band.

The miniaturized planar antenna 1 of the present invention can also be used for indoor and mobile reception.

Because the antennas are arranged in all four quadrants, the advantages of being horizontally polarized, omni-directional, wide band, and small size can be obtained. Moreover, because the DVB-T system adopts the modulation technology of COFDM, multi-path signals can be received for the purpose of constructive addition. Therefore, the present invention can match with the signal of electromagnetic wave of CODFM.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

We claim:

1. A miniaturized planar antenna of digital television reception, comprising:

a substrate having strip lines formed on upper and lower surfaces thereof; and a plurality of antennas arranged in a rampart-line manner;

wherein said upper and lower surfaces are virtually separated into four quadrants, said antennas are parallel disposed on said upper and lower surfaces of said substrate, intersect at said stripe lines, and are mirroringly distributed based on their counterparts in symmetric quadrants, and each said quadrant comprises at least three pairs of said antennas.

2. The miniaturized planar antenna of digital television reception as claimed in claim 1, further comprising a connector connected at a center of said strip line on said lower surface of said substrate, and passing through said upper and lower surfaces of said substrate via a feeding strip line.

3. The miniaturized planar antenna of digital television reception as claimed in claim 1, wherein said three pairs of antennas in one of said four quadrants are a first set, a second set, and a third set of antennas, respectively.

4. The miniaturized planar antenna of digital television reception as claimed in claim 3, further comprising a plurality of gaps disposed at the positions of each said set of antennas adjacent to said strip lines.

5. The miniaturized planar antenna of digital television reception as claimed in claim 1 further comprising a housing for receiving said miniaturized planar antenna being distant from a bottom of said housing more than or equal to 2 centimeters.

6. A miniaturized planar antenna of digital television reception, comprising:

a plurality of substrates including a first substrate, a second substrate, and an insulating substrate, respectively, said first substrate and said second substrate sandwiching said insulating substrates therebetween, and said first substrate and said second substrate having formed a plurality of strip lines on upper and lower surfaces thereof; and a plurality of antennas arranged in a rampart-line manner, said antennas being parallel disposed on said upper and lower surfaces of said first and second substrates, intersecting at said stripe lines, being mirroringly distributed as their counterparts in symmetric quadrants, and wherein each of said quadrants includes at least three pairs of antennas.

7. The miniaturized planar antenna of digital television reception as claimed in claim 6, further comprising a connector connected at a center of said strip line on said lower surface of said second substrate and passing through said upper and lower surfaces of said second substrate, said insulating substrate via a first feeding line and a second feeding line, said first feeding line electrically connecting said upper surface of said first substrate to said upper surface of said second substrate by means of electroplating, and said second feeding line connecting said lower surface of said first substrate to said lower surface of said second substrate by means of electroplating.

8. The miniaturized planar antenna of digital television reception as claimed in claim 6, wherein said three sets of antennas are divided a first set, a second set, and a third set of antennas, respectively, said first set, said second set, and said third set of antennas being distributed as their counterparts in symmetric said quadrants.

9. The miniaturized planar antenna of digital television reception as claimed in claim 8, further comprising a plurality of gaps disposed at positions of each said set of antennas adjacent to said strip lines.

10. The miniaturized planar antenna of digital television as claimed in claim 6 further comprising a housing for receiving said miniaturized planar antenna being distant from a bottom of said housing more than or equal to 2 centimeters.

* * * * *